US010791815B2

(12) United States Patent
Gregory

(10) Patent No.: US 10,791,815 B2
(45) Date of Patent: Oct. 6, 2020

(54) UV/LED GEL CURING LAMP

(71) Applicant: Reiauh Silvia Gregory, Los Angeles, CA (US)

(72) Inventor: Reiauh Silvia Gregory, Los Angeles, CA (US)

( * ) Notice: Subject to any disclaimer, the term of this patent is extended or adjusted under 35 U.S.C. 154(b) by 0 days.

(21) Appl. No.: 16/506,380

(22) Filed: Jul. 9, 2019

(65) Prior Publication Data

US 2020/0022476 A1 Jan. 23, 2020

Related U.S. Application Data

(60) Provisional application No. 62/699,321, filed on Jul. 17, 2018.

(51) Int. Cl.

| | |
|---|---|
| ***A45D 29/00*** | (2006.01) |
| ***F21V 1/00*** | (2006.01) |
| ***F21V 23/00*** | (2015.01) |
| *F21Y 115/10* | (2016.01) |

(52) U.S. Cl.

CPC ..... *A45D 29/00* (2013.01); *F21V 1/00* (2013.01); *F21V 23/003* (2013.01); *A45D 2200/155* (2013.01); *A45D 2200/205* (2013.01); *F21Y 2115/10* (2016.08)

(58) Field of Classification Search

CPC ..... A45D 29/00
USPC ..... 250/454.11, 453.11
See application file for complete search history.

(56) References Cited

U.S. PATENT DOCUMENTS

| | | | | |
|---|---|---|---|---|
| 5,249,367 | A * | 10/1993 | Nafziger | A45D 29/18 34/202 |
| 5,501,682 | A * | 3/1996 | Edwards-Cofie | A45D 29/22 132/73.5 |
| 2006/0076028 | A1* | 4/2006 | Lee | A45D 29/00 132/74.5 |
| 2009/0143842 | A1* | 6/2009 | Cumbie | A61N 5/0616 607/88 |
| 2012/0204341 | A1* | 8/2012 | Nguyen | A61H 35/006 4/621 |
| 2016/0309877 | A1* | 10/2016 | Papshev | A45D 29/00 |
| 2016/0353856 | A1* | 12/2016 | Horvath | A45D 29/22 |
| 2017/0006994 | A1* | 1/2017 | King | A45D 29/22 |

OTHER PUBLICATIONS

Bella Nails Nail Lamp, www.amazon.com.
Bella Nails Nail Lamp, www.bellanails.us.
Bella Nails Nail Lamp, www.ebay.com.
Bella Nails Nail Lamp, www.walmart.com.
CCFL Nail Lamp, www.amazon.com.
CCFL Nail Lamp, www.ebay.com.
DND Nail Lamp, www.amazon.com.
DND Nail Lamp, www.beyondpolish.com.

(Continued)

*Primary Examiner* — Jason L McCormack

(57) ABSTRACT

UV, LED, and UV/LED hybrid gel curing lamps which lessen the exposure to radiation from gel manicures and pedicures are disclosed. The lamp exposes only the fingertips or toetips to the radiation, thus lessening the total exposure to the user. This decrease in exposure prevents DNA damage to skin. Additionally, the present invention features a proper gel pedicure lamp which extends across a pedicure bowl so as to provide for the safety and comfort of the user.

3 Claims, 7 Drawing Sheets

(56) References Cited

OTHER PUBLICATIONS

Figure 1:
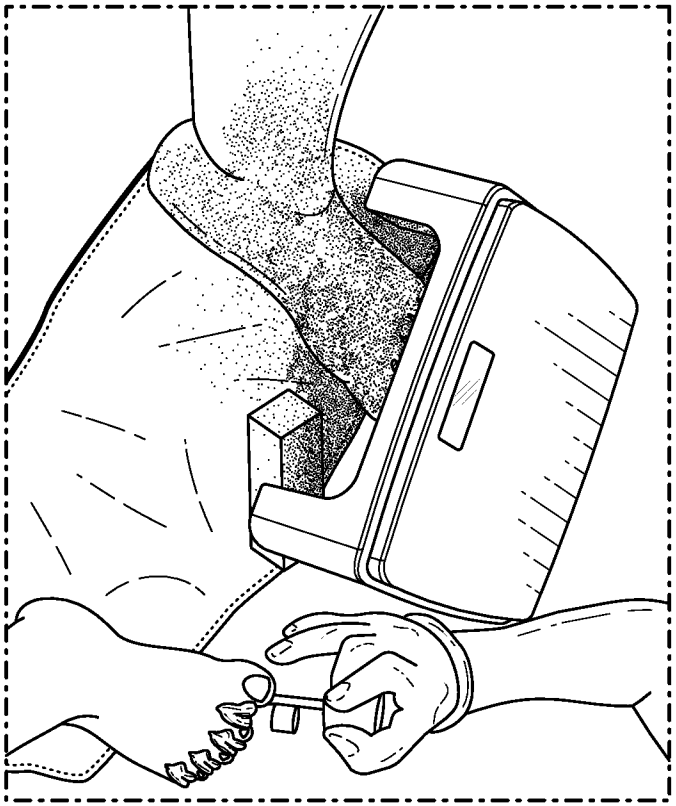

DND Nail Lamp, www.ebay.com.
Gelish Nail Lamp, www.amazon.com.
Gelish Nail Lamp, www.gelish.com.
Gelish Nail Lamp, www.sallybeauty.com.
Gelish Nail Lamp, www.walmart.com.
Melodysusie Nail Lamp, www.amazon.com.
Melodysusie Nail Lamp, www.ebay.com.
Melodysusie Nail Lamp, www.melodysusie.com.
Melodysusie Nail Lamp, www.sears.com.
Melodysusie Nail Lamp, www.walmart.com.
Nailstar Nail Lamp, www.amazon.com.
Nailstar Nail Lamp, www.ebay.com.
Nailstar Nail Lamp, www.nailstarprofessional.com.
OPI Nail Lamp, www.amazon.com.
OPI Nail Lamp, www.ebay.com.
OPI Nail Lamp, www.opi.com.
OPI Nail Lamp, www.walmart.com.
Sunuv Nail Lamp, www.amazon.com.
Sunuv Nail Lamp, www.ebay.com.
Sunuv Nail Lamp, www.etsy.com.
Sunuv Nail Lamp, www.sunuvstore.com.
Sunuv Nail Lamp, www.walmart.com.

* cited by examiner

UV/LED GEL CURING LAMP

CROSS-REFERENCES TO RELATED APPLICATIONS

This application is a non-provisional application, and claims benefit of U.S. Patent Application No. 62/699,321, filed Jul. 17, 2018, the specification of which is incorporated herein in their entirety by reference.

BACKGROUND OF THE INVENTION

Field of the Invention

The present invention relates to UV/LED gel curing lamps. Specifically, the present invention relates to curing lamps for manicures and pedicures which lessen the exposure to radiation.

Background Art

Nail polish is commonly applied to fingernails and toenails, primarily for cosmetic reasons. Nail polish may be clear or pigmented, and may provide structural support to strengthen the underlying nail. While early polishes were designed to air dry, this drying required a waiting period during which the hand could not be freely used for fear of damaging the wet polish. Gel nails were developed to cure rather than simply dry, usually by exposure to UV, LED or UV/LED hybrid irradiation. This irradiation triggers chemical photo-initiators which promote chemical crosslinking of the gel to provide a robust hardened solid layer of polish.

Traditional manicure curing lamps feature a light housing with lights, which is raised on legs to provide a narrow pocket underneath for a flattened hand to extend underneath into a treatment zone. The user holds their fingers flat or curved slightly upwards, so as to expose the nails to the lights above, and holds the fingers spread apart, so as not to touch the wet nails against the adjacent fingers. Care is taken not to raise the hand too much for risk of smudging the wet nails against the lights. Sometimes, the hand is rotated slightly from side to side in order to uniformly expose the curved surfaces of the nails and especially to expose the thumb nail to the lights above. Because of the anatomy of the hand, when it is held in this flat position, the thumbnail is angled away from the direction that the fingernails are facing. As such, manipulation of the hand may be necessary to properly expose the thumb nail at the same time as the fingernails.

Exposure to radiation from UV-A rays causes damage to DNA in the skin, which may lead to skin cancer. A gel manicure or pedicure generally lasts two to three weeks. Thus, every two to three weeks, clients are exposing themselves to the radiation of the gel curing lamp. Current gel lamps unnecessarily expose the entire hand or foot to radiation from the UV/LED lamp, thus increasing chances of DNA damage to the skin. Clients are encouraged to use gloves with only the fingertips exposed or to wear sun tan lotion for 20 minutes before a gel manicure or pedicure to protect from radiation. These two options are not commonly provided in salons, so there is an increased risk of skin damage to the client.

A proper pedicure lamp does not exist. Instead, the same lamp that is used for manicures is also used for pedicures. The lamp is not designed for such use and is unstable when used for a pedicure and is often held in place on a pedicure chair by the foot being treated. This is potentially hazardous, as the foot could slip, and the lamp could break or hurt the client. Additionally, there is a risk that the wet nails of the foot holding the lamp in place could touch the lights and become smudged.

BRIEF SUMMARY OF THE INVENTION

It is an objective of the present invention to provide systems, devices, and methods, that allow for manicure and/or pedicure curing while lessening the exposure to radiation which could cause DNA damage to the skin, as specified in the independent claims. Embodiments of the invention are given in the dependent claims. Embodiments of the present invention can be freely combined with each other if they are not mutually exclusive. The present invention helps to reduce the risk of DNA damage to the skin from manicures and pedicures.

The present invention may feature a gel curing lamp which primarily exposes only the fingertips or toetips to radiation, thus lessening the exposure that can cause DNA damage to the skin. Additionally, the present invention may feature a gel manicure lamp designed to position the hand in a more natural curved configuration, instead of the traditional flat configuration. Additionally, the present invention may feature a proper gel pedicure lamp that extends properly across a pedicure bowl, insuring the safety and comfort of the client.

One of the unique and inventive technical features of the present invention is the creation of a narrow treatment zone which covers the nails but does not extend unnecessarily past the nails. Without wishing to limit the invention to any theory or mechanism, it is believed that the technical feature of the present invention advantageously provides for a reduction of the skin's exposure to radiation and a lowered risk of DNA damage. None of the presently known prior references or work has the unique inventive technical feature of the present invention.

One of the ways that this narrow treatment zone is accomplished is by providing a raised palm rest for the hand to curve around, and a circular or semi-circular treatment zone around the raised palm rest. The prior references teach away from the present invention. For example, in the industry, manicure curing is done with the hand in a flat configuration so as to allow for uniform exposure of the nails. Furthermore, the inventive technical features of the present invention contributed to a surprising result. For example, when the hand is in a curved configuration, each of the fingertips may enter a narrow treatment zone which is only about the width of the nail length. When the hand is in a flat configuration, as is the industry standard, the varying finger lengths prevent the fingertips from equally abutting a flat edge. Instead, the position of the nails is staggered and a single treatment zone which covers all the nails must be much wider than the length of the nails, so as to cover all of the nails together.

The gel curing lamps of the present invention may feature integrated massage components. In the industry, the hands are sometimes massaged before the gel curing. It is surprising to massage the hands during the gel curing process as the gel curing process is typically short in duration and the hands are traditionally held in a flat, uncomfortable configuration. Because the gel manicure curing lamps of the present invention provide for a more natural and comfortable curved position, a massage is more suitable. Additionally, the gel manicure curing lamps of the present invention feature a raised palm rest which is configured to contact the hand and is a suitable place for the positioning of massage components whereas traditional gel manicure curing lamps do not have any similar component for the hand to rest upon which could include massage components. Furthermore, as no pedicure specific gel curing lamps are known to exist, no gel curing lamps could have components designed for massaging the feet.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

BRIEF DESCRIPTION OF THE SEVERAL VIEWS OF THE DRAWING(S)

The features and advantages of the present invention will become apparent from a consideration of the following detailed description presented in connection with the accompanying drawings in which:

FIG. 1 shows an illustration of the use of a manicure lamp to cure a gel pedicure. The manicure lamp is held in place by the foot and could slip and fall.

Figure 2A:
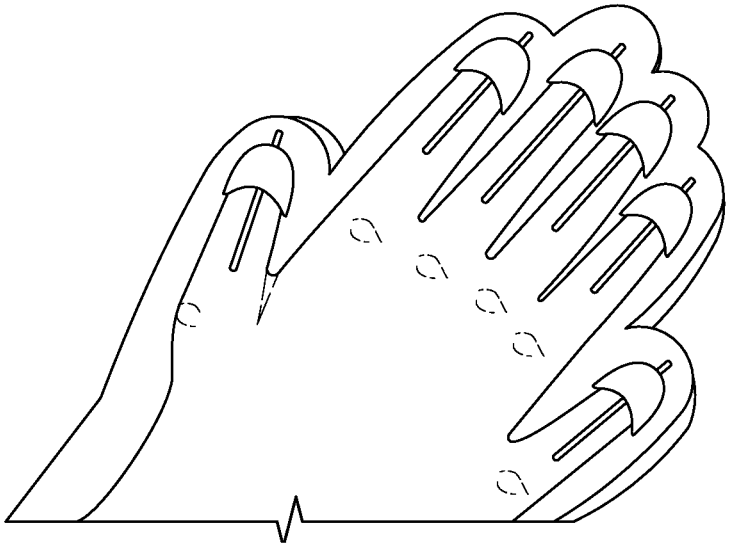
Figure 2B:
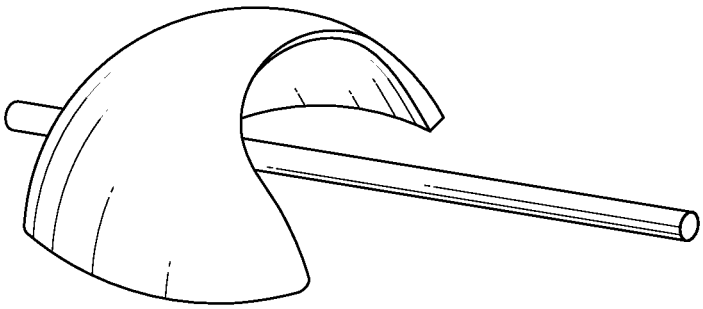

FIGS. 2A-2B show a UV/LED gel manicure lamp having a fingertip pod with an adjustable base. FIG. 2A shows an illustration of the adjustable base. FIG. 2B shows an illustration of the UV fingertip pod.

Figure 3A:
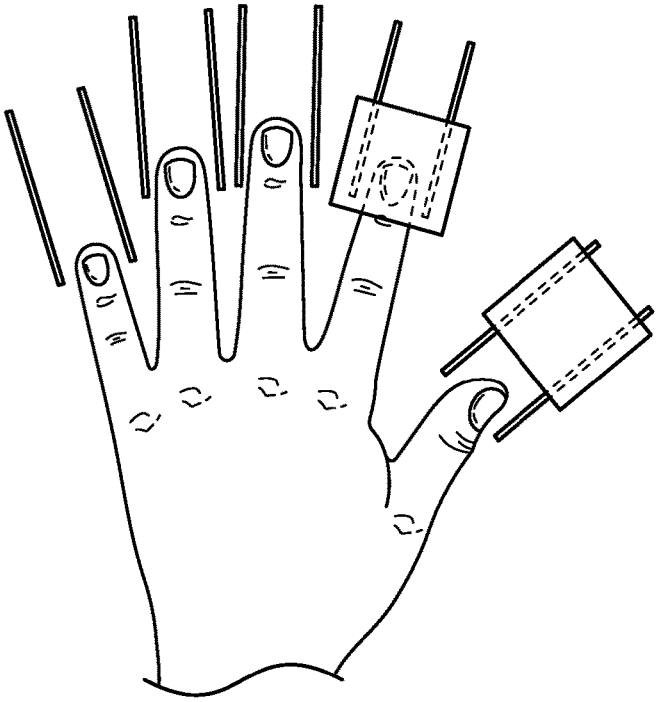
Figure 3B:
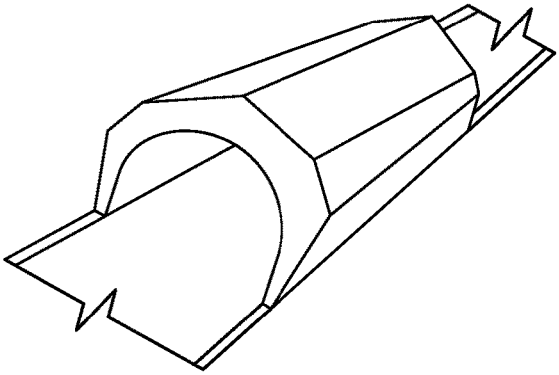
Figure 3C:
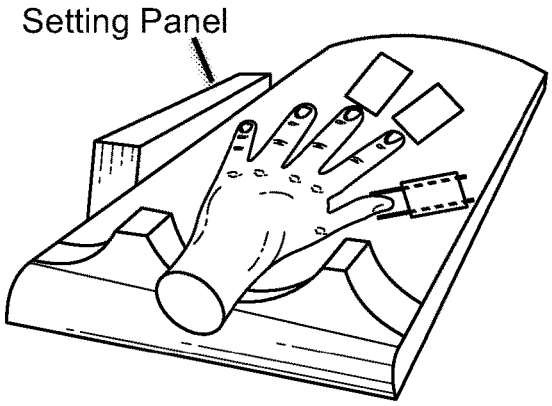

FIGS. 3A-3C show a UV/LED gel manicure lamp having a slide in place fingertip house design, hand base, and wrist rest with setting or control panel. FIG. 3A shows a top view illustration of a hand on the base with a housing covering a fingertip. FIG. 3B shows an illustration of a slide in place UV fingertip housing design. FIG. 3C shows an illustration of a hand base with a wrist rest and setting panel.

Figure 4A:
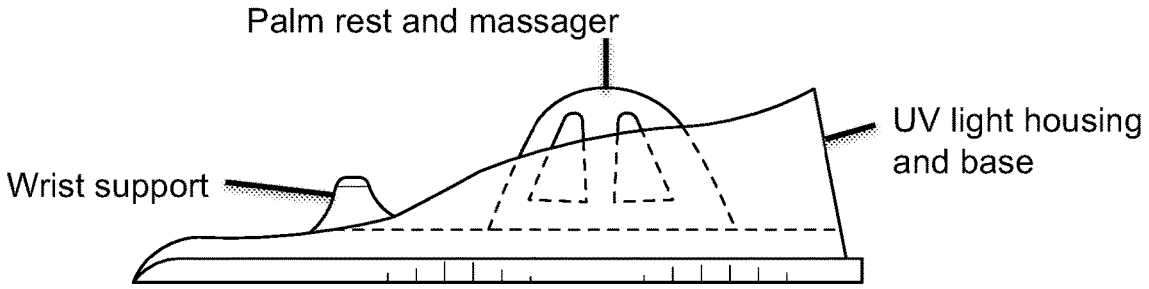
Figure 4B:
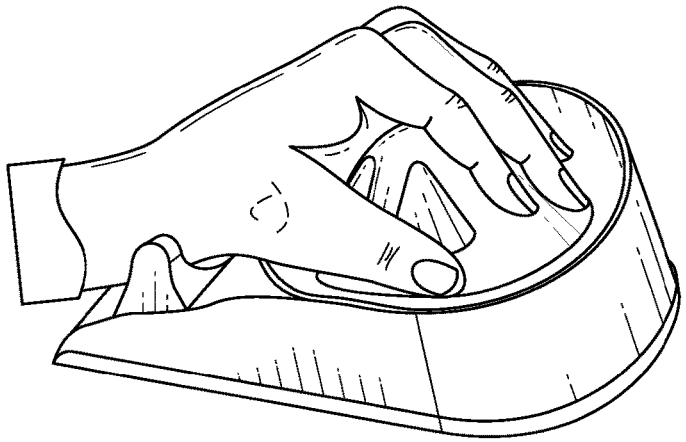
Figure 4C:
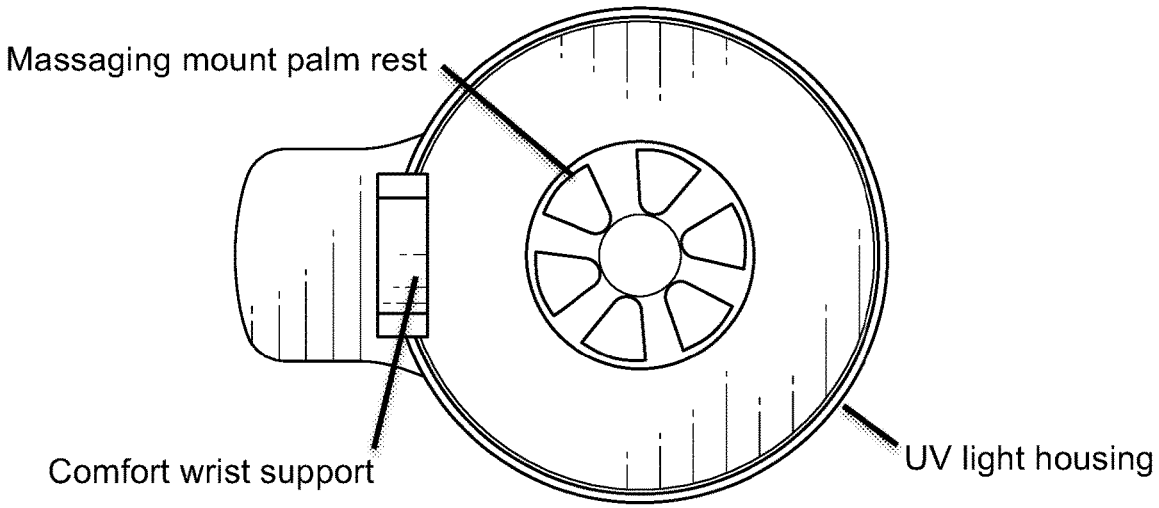

FIGS. 4A-4C show a UV/LED gel manicure lamp having a UV/LED light housing, a massaging mount palm rest, and a comfort wrist support. FIG. 4A shows a side view illustration. FIG. 4B shows a perspective view illustration. FIG. 4C shows a top view illustration.

Figure 5A:
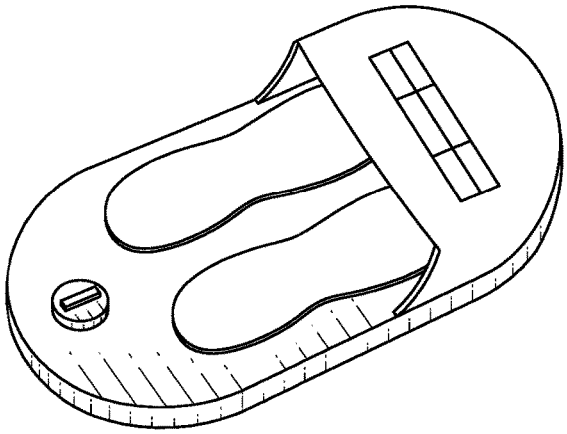
Figure 5B:
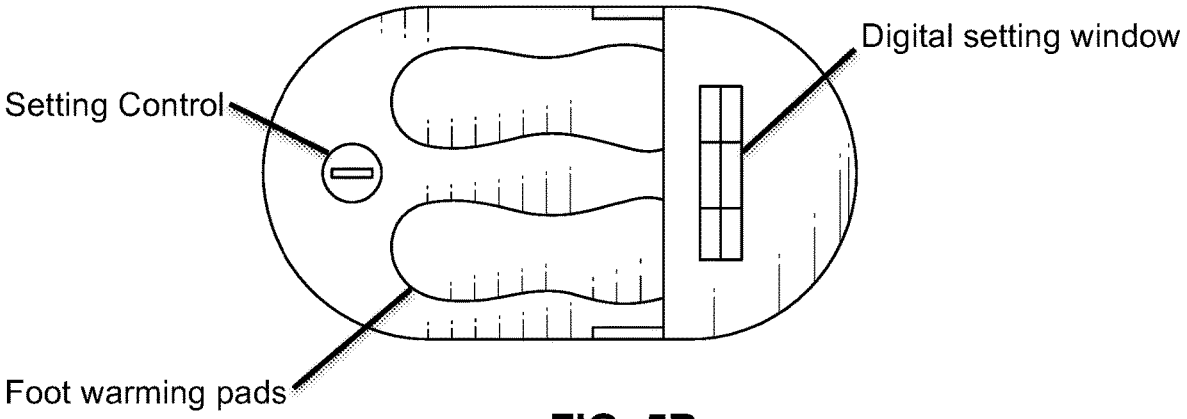
Figure 5C:
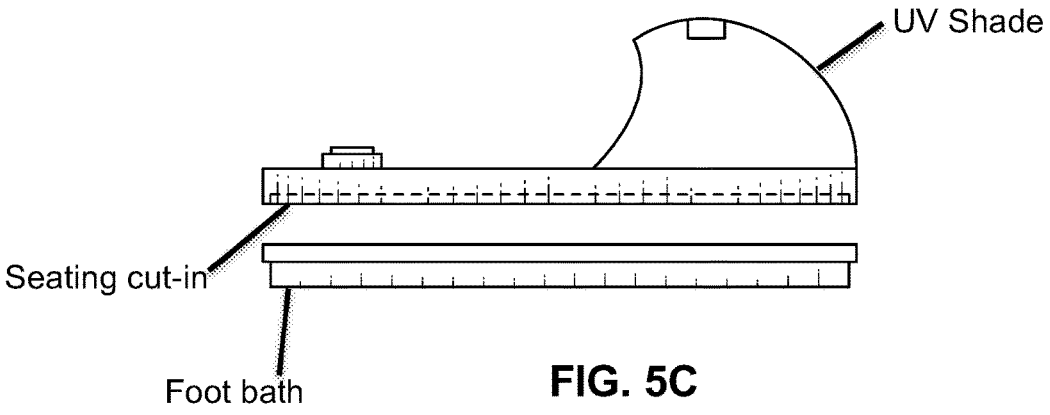

FIGS. 5A-5C show a UV/LED gel pedicure lamp having a UV/LED light housing, a touch screen control panel, a sunken footrest, and an adjustable pull out bowl rest to secure the lamp around the pedicure bowl. FIG. 5A shows a perspective view illustration. FIG. 5B shows a top view illustration. FIG. 5C shows a side view illustration.

Figure 6A:
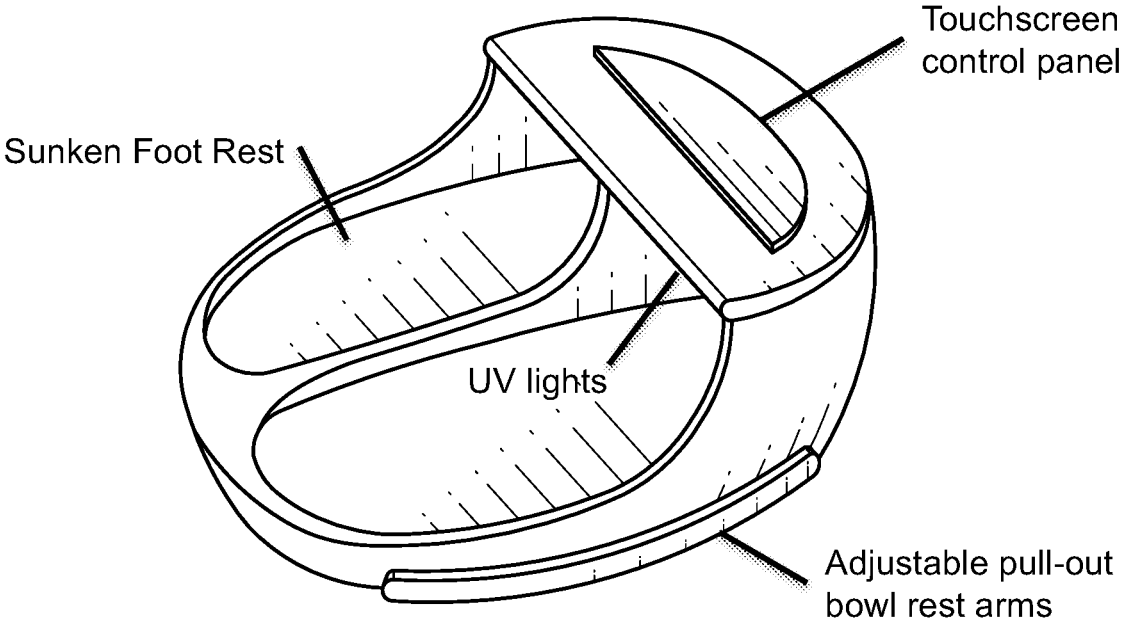
Figure 6B:
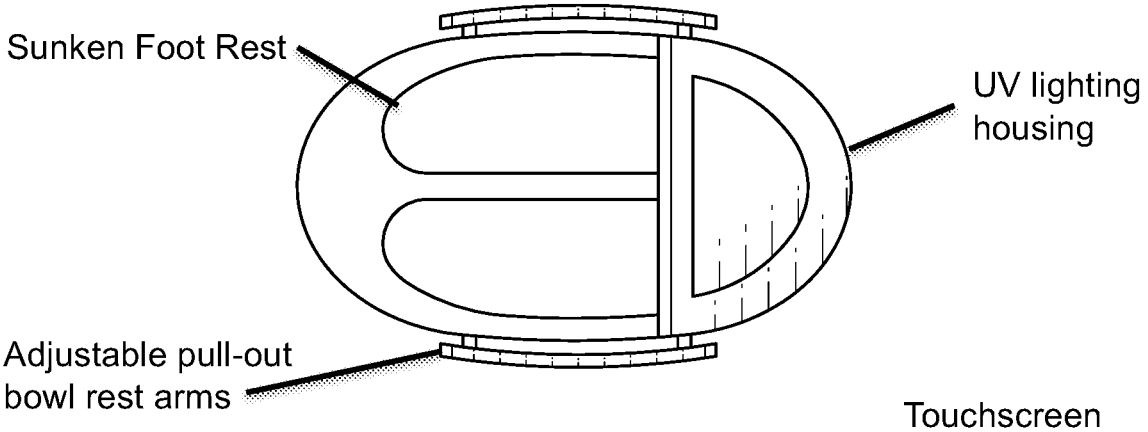
Figure 6C:
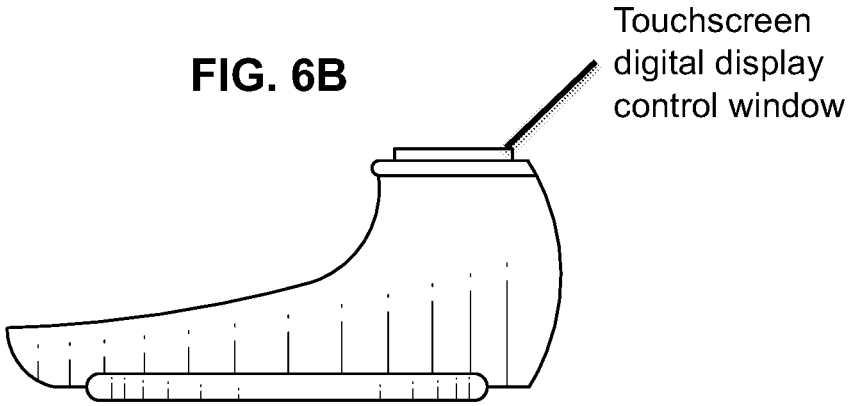

FIGS. 6A-6C show a UV/LED gel pedicure lamp having a UV/LED digital setting window, a setting control for foot warming pods, a UV/LED shade, and a pull-out bowl rest to secure the lamp over a pedicure bowl. FIG. 6A shows a perspective view illustration. FIG. 6B shows a top view illustration. FIG. 6C shows a side view illustration.

Figure 7A:
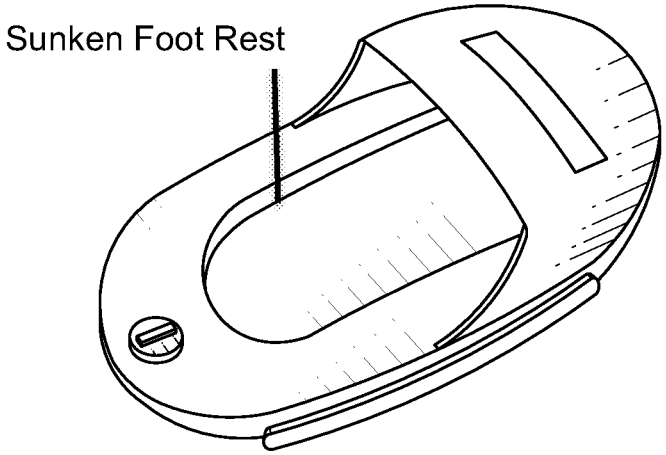
Figure 7B:
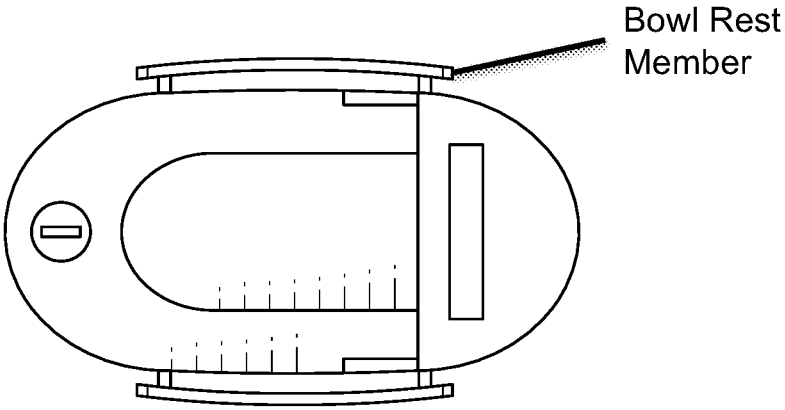
Figure 7C:
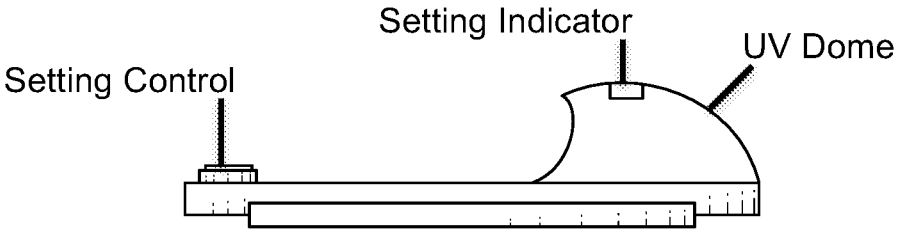

FIGS. 7A-7C show a UV/LED pedicure lamp having a UV/LED dome, a setting indicator for a timer, one sunken heated footrest, a temperature setting control, and a pull-out bowl rest to secure the lamp over a pedicure bowl. FIG. 7A shows a perspective view illustration. FIG. 7B shows a top view illustration. FIG. 7C shows a side view illustration.

DETAILED DESCRIPTION OF THE INVENTION

In one embodiment, the present invention features a gel manicure lamp. FIGS. 2A-2B and 3A-3C show an example gel manicure lamp of the present invention. One limitation of this example is that the adjustable fingertip pods may cause electrical issues, and may be uncomfortable for the client. FIGS. 4A-4C shows an advanced model that offers a comfortable palm rest with a massage base. There is also a wrist support, and the UV/LED light is only emitted on the client's fingertips. The circular model allows a comfortable fit for users with different hand sizes. FIGS. 5A-5C and 6A-6C show an example of a gel pedicure lamp of the present invention. The components included an adjustable pullout bowl rest, sunken footrest, UV lighting housing, touch screen digital display control window (timer for UV/LED drying), and setting control for foot warming pads. FIGS. 7A-7C shows a model with only one sunken footrest, as one foot would be drying as the other is serviced. This model would be a more economical option as it would require less material to manufacture.

In some embodiments, the present invention features a circular gel manicure lamp. This circular design provides a modern look, and it is also comfortable for the client. The massage base allows the client to experience a hand massage while drying or curing their nails. The comfort wrist support positions the client's hand in the proper position and orientation and ensures that the client's hand does not slip. The UV housing is designed to only emit radiation onto the client's fingertips. The rest of the client's hand is shielded from exposure, thus lessening the chances of DNA damage to the skin.

In other embodiments, the present invention features a gel pedicure lamp. This pedicure lamp includes a sunken footrest to provide comfort for the client's foot. The footrest may also be heated and have a setting control to provide for temperature comfort. The UV/LED dome only exposes the client's toes to the radiation while minimizing exposure to the rest of the foot. The lamp may also feature a setting indicator that sets a timer for a duration in which the light is to be emitted. The slide out seater (adjustable pull out bowl rest) allows for salons/spas to adjust the pedicure lamp to fit properly across their pedicure bowl. This insures that the lamp is stable and secure.

In order to manufacture the lamps, molds of the manicure and pedicure lamp may need to be created. Electrical engineering would allow the intensity of light emitted for curing the nails, the timer for the lamp, massage palm rest, and heated sunken footrest. A light housing may be configured to hold one to five (or more) UV/LED lamps depending on the size of the models. The wavelengths of the UV lights may range between 320 to 400 nm. More specifically, the wavelengths may be selected so as to activate the photo initiator in the gel polish.

The circular shape of the gel manicure model, the UV light housing, the UV light, and the comfort wrist support should be created. For the pedicure lamp, the shape of the actual model, the sunken footrest, digital setting window, UV lamp and housing, and the pullout bowl rest should be created.

The gel manicure lamp may be designed with or without a palm massage. Additionally, the massage may be heated. The gel lamp may also feature a timer for a duration of the light emitted. The gel pedicure lamp may feature a heated sunken footrest a sunken footrest without the heating component. The gel pedicure lamp may also feature a massage component in the sunken footrest.

Salon/Spa owners may use the gel manicure/pedicure lamps in their salon without having to make any changes to the equipment they already have. The invention will be desirable because of the health risk of skin cancer which is increasingly recognized as an issue. The invention may provide a healthier approach to the gel manicure/pedicure that is dominating the nail salon industry as it lessens the exposure of radiation. The present invention features a modern look and feel, and provides comfort for the user. The invention could also be designed for a client to use to their convenience outside of an actual salon. The simplicity of the present invention allows a client to perform their own gel manicure/pedicure in the privacy of their own home.

In one embodiment, the present invention features a gel curing lamp. As a non-limiting example, the lamp may comprise: a base member, a light housing, one or more UV, LED, or UV and LED curing lights, and one or more irradiation shades. In preferred embodiments, the base member may be shaped so as configured to position a hand or a foot in a location on the base member with an orientation such that a plurality of nails on the hand or foot are in a treatment zone. This treatment zone should ideally be wide enough to cover all of the nails simultaneously, but narrow enough to avoid unnecessary exposure to irradiation.

In some embodiments, the light housing may be integrated with the base member, either as one single piece, or as multiple joined pieces. In some embodiments, the UV, LED, or UV and LED curing lights may be housed within the light housing and configured to irradiate the treatment zone. The curing lights may have identical or differing wavelengths of light. In some embodiments, the irradiation shades may be coupled with the light housing, so as to reduce irradiation outside of the treatment zone. The irradiation shades may be fixed or adjustable. In some embodiments, the base member may comprise an integrated massage component, configured to massage the hand or foot. As a non-limiting example, the base member may comprise a rotating massage component underneath of a flexible cover. In some embodiments, the lamp may comprise a control panel. As a non-limiting example, the control panel may allow for control of an irradiation intensity or an irradiation duration. The control panel may comprise an input mechanism such as a touchscreen, a button, a knob, a switch, a dial, a toggle, or an electronic input from an electronic device such as a cellphone or tablet. The control panel may feature preset options or variable controls. The control panel may feature separate controls for the lights, the massage component, and the heating element. The control panel may feature one or more displays to show feedback to the user or the settings of the lamp.

In one embodiment, the present invention features a manicure gel curing lamp for a hand in a curved configuration. As a non-limiting example, the lamp may comprise: a base member; a raised palm rest integrated with the base member; a circular or semi-circular light housing, integrated with the base member and disposed around the raised palm rest; a circular or semi-circular treatment zone, between the raised palm rest and the light housing; and one or more curing lights housed within the light housing. In some embodiments, the curing lights may be configured to irradiate the treatment zone. These curing lights may be UV, LED, or UV and LED curing lights. In some embodiments, the lamp may be configured to position the hand in a curved configuration on a location on the base member with an orientation such that a palm of the hand rests on the raised palm rest, and a plurality of nails on the hand are in a treatment zone. As a non-limiting example, the fingers of the hand may curve around the raised palm rest such that each of the nails is about the same distance above the base member and pointed away from the base member and toward the light housing.

In some embodiments, the lamp may additionally comprise one or more irradiation shades coupled with the light housing. These irradiation shades may be configured to reduce irradiation outside of the treatment zone, thereby reducing skin exposure to the curing lights. The irradiation shades may contact the fingers or may operate at a distance from the fingers. As a non-limiting example, the irradiation shade may comprise a horizontal, nearly horizontal, angled, or curved lip around a top of the light housing, extending towards the raised palm rest. As another non-limiting example, the irradiation shade may comprise a separate lid which fits over the light housing. In one embodiment, this lid may be hinged. In another embodiment, the lid may be fully removable. In still another embodiment, the lid may be flexible.

In some embodiments, the lamp may additionally comprise a wrist support attached to the base member. This wrist support may help to position the hand correctly on the base member and may also provide comfort and stability to the user. In some embodiments, the height of the wrist support may effect the curvature of the hand over the raised palm rest. In some embodiments, the raised palm rest may comprise a massage palm rest configured to massage the palm of the hand. In some embodiments, the raised palm rest may comprise a heating element configured to warm the palm of the hand.

In one embodiment, the treatment zone may extend upwardly from the base member about the length one of the nails. As a non-limiting example, the treatment zone may have a height of about 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, 50 or over 50 mm. The height of the treatment zone may be either fixed or adjustable. In one embodiment, the height of the treatment zone may be adjusted by changing the positioning of an irradiation shade. In one embodiment, the upper limit of the treatment zone is based on the length of an average user's fingers so as to align with or slightly above the fingernail bases, and the lower limit is low enough to accommodate nails with a variety of lengths.

In some embodiments, the lamp may be symmetrical and may be used for a left hand or a right hand. Alternatively, non-symmetrical, separate lamps may be designed to perfectly fit each of the left and the right hands. In some embodiments, the raised palm rest may have one or more indentations or protrusions for a thumb, so as to position the thumbnail facing towards the light housing. In some embodiments, the raised palm rest may be shaped so as to position the thumbnail at a same height above the base member as the fingernails. In some embodiments, the lamp may be integrated into an armrest of a chair, such as a chair in a nail salon, and may massage the hands even when the curing lights are off.

In one embodiment, the present invention features a pedicure gel curing lamp. As a non-limiting example, the lamp may comprise: a base member, a light housing, one or more curing lights, and one or more irradiation shades. In some embodiments, the base member may be shaped so as configured to position a foot in a location on the base member with an orientation such that a plurality of nails on the foot are in a treatment zone. As a non-limiting example, the treatment zone may focus irradiation on the toenails while preventing unnecessary irradiation exposure to the rest of the foot. In some embodiments, the light housing may be integrated with the base member, either as a single piece or as multiple connected pieces. In one embodiment the light housing may be positioned above the base member so as to form a pocket between the light housing and the base member, for the toes to be inserted into when the foot is positioned on the base member. In some embodiments, the curing lights may be configured to irradiate the treatment zone with an intensity and for a duration so as to cure a gel coat on nails positioned within the treatment zone. In some embodiments, the irradiation shades may be configured to reduce irradiation outside of the treatment zone so as to prevent unnecessary skin exposure to the irradiation. The irradiation shades may be either fixed or adjustable and may extend horizontally, vertically, at an angle, or with a combination thereof.

In some embodiment, the base member may comprise at least one, one, or two, sunken footrests. In some embodiments, the footrest may comprise a heating element configured to warm the foot. In some embodiments, the footrest may comprise a massage unit configured to massage the foot. In some embodiments, the base member may comprise one or more bowl rest members configured to position and secure the lamp over a pedicure bowl. As a non-limiting example, the bowl rest members may be extendable and adjustable so as to fit various sizes of pedicure bowls. As an additional non-limiting example, the bowl rest member may be configured to fit a pedicure bowl with a diameter of about 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, or over 40 cm. As still another non-limiting example, the lamp may comprise 1, 2, 3, 4, 5, 6, 7, 8, or more than 8 bowl rest members. In some embodiments, the bowl rest members may elastically extend and return so as to secure the lamp via an elastic force. In other embodiments, the bowl rest members may mechanically lock in place to secure the lamp via a mechanical force. In some embodiments, the light housing may comprise a dome which is configured to extend overtop of the nails and also serve as an irradiation shade.

In one embodiment, the present invention features a method for curing a gel manicure or pedicure using any of the lamps described herein. As a non-limiting example, the method may comprise: positioning the hand or foot with an uncured gel manicure or pedicure on the lamp, turning the lamp on with a set intensity and for a set duration so as to cure the gel manicure or pedicure, optionally turning on massaging or heating capabilities during the set curing duration, and removing the hand or foot from the lamp or turning off the lamp when the duration is finished.

As used herein, the term "about" refers to plus or minus 10% of the referenced number.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims. In some embodiments, the figures presented in this patent application are drawn to scale, including the angles, ratios of dimensions, etc. In some embodiments, the figures are representative only and the claims are not limited by the dimensions of the figures. In some embodiments, descriptions of the inventions described herein using the phrase "comprising" includes embodiments that could be described as "consisting essentially of" or "consisting of", and as such the written description requirement for claiming one or more embodiments of the present invention using the phrase "consisting essentially of" or "consisting of" is met.

What is claimed is:

1. A manicure gel curing lamp for a hand in a curved configuration, comprising:

a base member;

a raised palm rest integrated with the base member;

a circular or semi-circular light housing, integrated with the base member and disposed around the raised palm rest;

a circular or semi-circular treatment zone, between the raised palm rest and the light housing; and one or more curing lights housed within the light housing, the curing lights configured to irradiate the treatment zone;

wherein the lamp is configured to position the hand in a curved configuration on a location on the base member with an orientation such that a palm of the hand rests on the raised palm rest, and a plurality of nails on the hand are in a treatment zone;

wherein the raised palm rest comprises a massage palm rest configured to massage the palm of the hand.

2. A pedicure gel curing lamp, comprising a base member, shaped so as configured to position a foot in a location on the base member with an orientation such that a plurality of nails on the foot are in a treatment zone;

a light housing, integrated with the base member;

one or more curing lights housed within the light housing, the curing lights configured to irradiate the treatment zone;

one or more irradiation shades coupled with the light housing, configured to reduce irradiation outside of the treatment zone;

wherein the base member comprises one or more bowl rest members configured to position and secure the lamp over a pedicure bowl.

3. A pedicure gel curing lamp, comprising a base member, shaped so as configured to position a foot in a location on the base member with an orientation such that a plurality of nails on the foot are in a treatment zone;

a light housing, integrated with the base member;

one or more curing lights housed within the light housing, the curing lights configured to irradiate the treatment zone;

one or more irradiation shades coupled with the light housing, configured to reduce irradiation outside of the treatment zone;

wherein the base member comprises one or more bowl rest members configured to position and secure the lamp over a pedicure bowl;

wherein the bowl rest members are extendable and adjustable so as to fit various sizes of pedicure bowls.

* * * * *